United States Patent [19]

Robinson

[11] Patent Number: 5,016,365

[45] Date of Patent: May 21, 1991

[54] WEAR PARTS FOR EXCAVATION APPARATUS

[75] Inventor: Howard W. Robinson, Grapevine, Tex.

[73] Assignee: GH Hensley Industries, Inc., Dallas, Tex.

[21] Appl. No.: 533,900

[22] Filed: Jun. 6, 1990

Related U.S. Application Data

[63] Continuation of Ser. No. 362,702, Jun. 6, 1989, abandoned.

[51] Int. Cl.[5] ..... E02F 9/28

[52] U.S. Cl. ..... 37/141 T; 37/142 R

[58] Field of Search ..... 37/141 R, 141 T, 118 A, 37/118 R, 142 R

[56] References Cited

U.S. PATENT DOCUMENTS

| | | | |
|---|---|---|---|
| 3,762,079 | 10/1973 | Lukavich et al. | 37/141 R |
| 3,961,788 | 6/1976 | Helton et al. | 37/141 T X |
| 3,984,929 | 10/1976 | Meyer et al. | 37/141 R |
| 4,006,544 | 2/1977 | Stepe | 37/141 T |
| 4,238,896 | 12/1980 | Lanz et al. | 37/141 R |
| 4,570,365 | 2/1986 | Bierwith | 37/141 T |

*Primary Examiner*—Randolph A. Reese
*Assistant Examiner*—Arlen L. Olsen
*Attorney, Agent, or Firm*—John M. Cone

[57] ABSTRACT

An improved wear assembly for a ground engaging tool, such as an excavator bucket, comprises a lip protector shroud which is detachably mounted on the bucket lip to cover the lip and provide a wear bearing surface that covers the lower surface of the tooth adapter and which is detachably held in place by abutment against a tooth detachably mounted on the adapter and a flexible pin extending through registering apertures in the adapter and the shroud.

8 Claims, 7 Drawing Sheets

WEAR PARTS FOR EXCAVATION APPARATUS

This is a continuation of U.S. application Ser. No. 362,702, which is now abandoned.

TECHNICAL FIELD

Present invention relates generally to ground engaging apparatus including loaders and excavators, and more particularly provides a unique assembly for installation on buckets or shovels (hereinafter "bucket") of such apparatus to prevent wear on certain parts of the bucket and to enable those parts of the bucket that are subject to wear to be economically replaced.

BACKGROUND OF THE INVENTION

Large ground engaging buckets are typically provided with a series of earth-cutting teeth mounted along a forward lower lip of the bucket. The teeth are the part of the apparatus which is most subject to wear and various proposals have been made to provide configurations which allow for the efficient replacement of the tooth as it is worn during use. One such example is the tooth and wear cap assembly described in U.S. Pat. No. 4,716,667 (Martin). Even with use of the wear cap assembly, the lower surface of the bucket, particularly the underside of the tooth adapters and the portions between the teeth, is frequently subjected to considerable wear forces and tend to be relatively rapidly damaged during use.

Various proposals have been made in the past to protect the lower surface of the bucket, for example, G.H. Hensley Company has sold two-piece wear parts in the form of individual adapters which are positioned by means of a shim and welded on the forward lower lip of the bucket between the excavating teeth. In U.S. Pat. No. 4,129,952 (Olson), the bottom and sides of a bucket have welded to them strips of material containing inserts of wear-resistant material and in U.S. Pat. No. 4,086,712 (McReynolds) the bucket is provided on its underside with ribs which cooperate with a paddle plate to form a box-like reinforcement.

While the above described proposals have successfully extended the working life of a bucket between repairs, there is still room for considerable improvement and a need to provide a wear assembly which is swiftly, and hence economically, replaced with minimum down time of the apparatus, but which is, nevertheless, securely held on the bucket to minimize the risk of the wear part, the excavating tooth, or its associated adapter, becoming detached from the bucket during use.

It is an object of the present invention to provide a wear assembly and the individual parts thereof for protecting the edges of a bucket of a ground engaging apparatus to improve the resistance of the bucket to wear and extend the useful working life of the bucket and its excavating teeth between services.

It is a further object to provide a wear assembly which, while providing enhanced protection does not, by reducing the effective penetrating length of the excavating teeth, detract from the efficiency of the bucket's operation.

SUMMARY OF THE INVENTION

The present invention provides a wear assembly comprising replaceable wear shrouds, which protect the lip of the bucket and the underside of the teeth-mounting adapters and in which the two fastest wearing parts of the assembly, the excavating teeth and the shrouds, are detachable for easy and speedy replacement, but in which these parts are securely held on the bucket so the risk of either dropping off, in use, is minimized.

According to the present invention in at least one preferred form, there is provided a wear assembly for a bucket of an excavation apparatus comprising:

- a wear plate which, in use, is secured to the bucket and provides a forward lower lip of the bottom wall of the bucket;
- a plurality of adapters mounted at spaced apart locations on the forward edge of the wear plate;
- a plurality of hollow, replaceable, excavating teeth,
- a plurality of wear shroud means, each mounted on the forward edge of the wear plate, said wear shroud means each occupying the space between adjacent adapters and having a lower surface disposed in the same plane as the lower surface of the excavating teeth, and covering the bottom of the adjacent adapters, to provide a wear bearing, lower surface for the bucket.

The present invention also provides a wear part assembly for protecting a working edge of a ground engaging apparatus, such as an excavator or loader comprising:

- a plurality of adapters, each having a forwardly extending nose, two laterally-extending wedge-shaped flanges and a rearwardly extending mounting portion;
- a plurality of hollow, excavating teeth, each removably mounted on the forwardly extending nose of a respective adapter;
- a plurality of wear protecting shrouds, each including upper and lower spaced-apart, lateral ears defining between them a wedged-shaped channel adapted to engage the said wedge-shaped flanges;
- first pin means detachably securing the shrouds between the flanges of adjacent adapters; and second pin means securing each tooth on its respective adapter.

The present invention in another aspect also provides:

- a wear part assembly for protecting the working edge of excavation apparatus, such as a bucket, comprising:
- a plurality of adapters, each having a forwardly extending nose, two pairs of upper and lower laterally-extending wedge-shaped flanges and a reasonably extending mounting portion flanges;
- a plurality of hollow, excavating teeth, each removably mounted on the forwardly extending nose of a respective adapter;
- a plurality of wear protecting shrouds, each including upper and lower spaced-apart, lateral ears defining between them a wedged-shaped aperture adapted to engage the upper and lower surface of the wedge-shaped flanges;
- first pin means detachably securing the shrouds between the flanges of adjacent adapters; and second pin means securing each tooth on its respective adapter.

In another aspect, the present invention also provides:

- a wear assembly for protecting the vertical edge of a bucket of a ground engaging tool comprising:
- a lower vertical shroud detachably mounted on and surrounding the vertical edge of the bucket and restrained at its lower end against movement away from the vertical bucket edge by engagement between a lower extremity of the lower vertical shroud and an adapter for an excavating tooth;

a generally horizontal aperture in the upper end of the vertical shroud;

a mounting plate secured to the vertical bucket edge and engaging at its lower end an upper end of the lower vertical shroud and having an aperture which, in use, is in register with the aperture in the lower vertical shroud;

flexible pin means secured in the registering apertures in the lower vertical shroud and the mounting plate;

at least one upper vertical shroud, detachably secured to and surrounding the vertical edge of the bucket, having a lower extremities, which is complementary, in shape, to the shape of the upper extremity of the lower vertical shroud, and an upper extremity which is the same shape as the upper extremity of the lower vertical shroud;

a generally horizontal aperture in the upper end of each upper vertical shroud whereby the upper vertical shroud is detachably secured to the bucket edge by means of a second mounting plate secured to the bucket edge and having a registering generally vertical aperture in which is received a flexible pin means.

DETAILED DESCRIPTION

General Configuration

Figure 1:
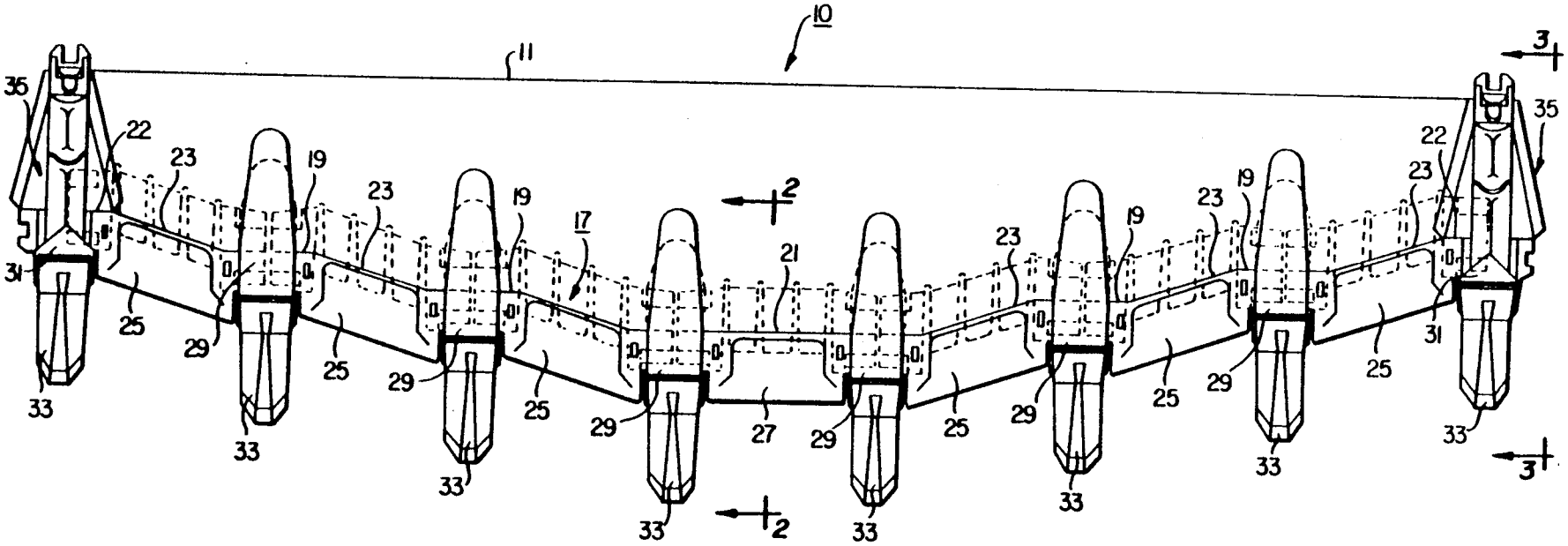
FIG. 1 is a plan view of a wear plate assembly for mounting on the forward edge of an excavating bucket.

Referring firstly to FIG. 1, the wear plate assembly comprises, for example, a 2½ inch thick, steel plate 10 which, in plan, has a straight rear edge 11 having a chamfered top edge (not shown). The sides of the plate 10, in this form of the invention, converge slightly inwardly to meet a stepped, forward edge 17 of the plate 10, forming a lip for an excavating tool, and having a shape that is frequently referred to in the art as a clip "V" blade.

Those skilled in the art will appreciate that the teaching of this invention can be readily applied to blades of other shapes, such as straight blades and spade nose blades. Similarly, although in the particular example described below the assembly comprises eight excavating teeth and associated adapters and seven wear shrouds, the skilled reader will appreciate that the particular number and form of these parts will depend on the dimensions and geometry of the bucket.

The forward edge 17 includes four adapter-receiving portions 19, which are aligned parallel to the rear edge 11, a center portion 21 at the widest part of the plate 10 and two outer portions 22. In addition, the forward edge 17 of the plate 10 includes six angled portions 23 which extend at an angle of, for example, about 20 degrees to the rear edge 11 and interconnect the adjacent adapter-receiving portions 19 and the outer portions 19 to the outer portions 22. The angled portions 23 receive, as will be explained in more detail below, angled lip protector wear shrouds 25. A center lip protector wear shroud 27 is mounted on the center portion 21 of the forward edge 17 of the plate 10.

The wear plate assembly further includes six center adapters 29 mounted on the forward edge 17 of the plate lip 10. Four of the center adapters 29 are mounted on the adapter-receiving portions 19 and two are mounted on the center portion 21 at each end thereof and on either side of the center shroud 27. Two corner adapters 31 are mounted respectively on the two outer ends of the forward edge 17 of the plate 10. As will be described in more detail below, a hollow excavating tooth 33 is mounted on each adapter 29, 31.

The cheek plates of the excavating bucket (not shown) are protected by left and right side vertical shroud assemblies 35 (FIG. 3), each of which comprises an upper vertical shroud 37 and a lower vertical shroud 39 interconnected by a vertical shroud mount 41. The detailed construction and configuration of the vertical shroud assemblies 35 will be described in greater detail below.

The above description outlines the major components making up the wear plate assembly of this invention. The individual components of the assembly will now be described in greater detail.

ADAPTERS

Figure 4:
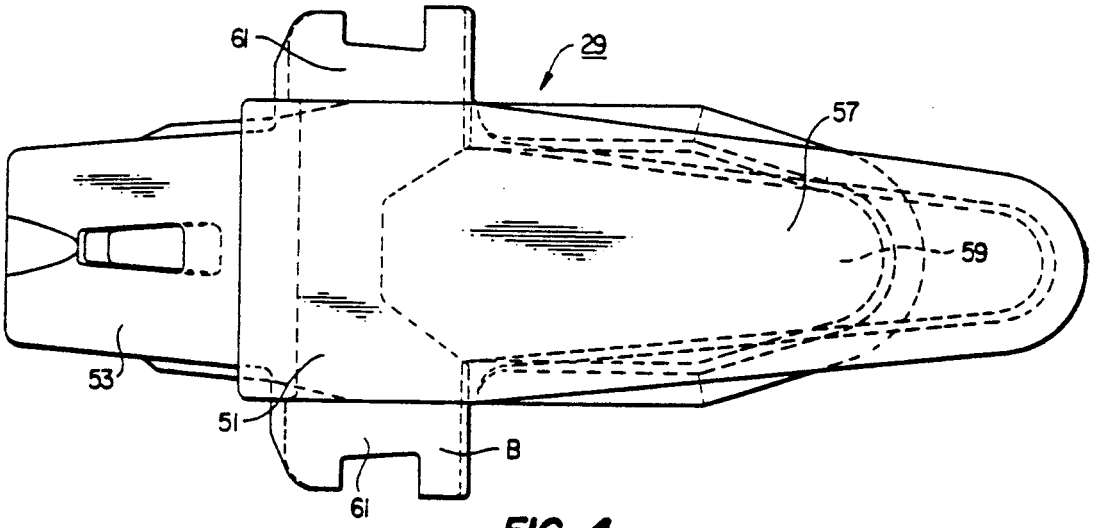
FIG. 4 is a plan view of one of the center adapters shown in FIG. 1.
Figure 5:
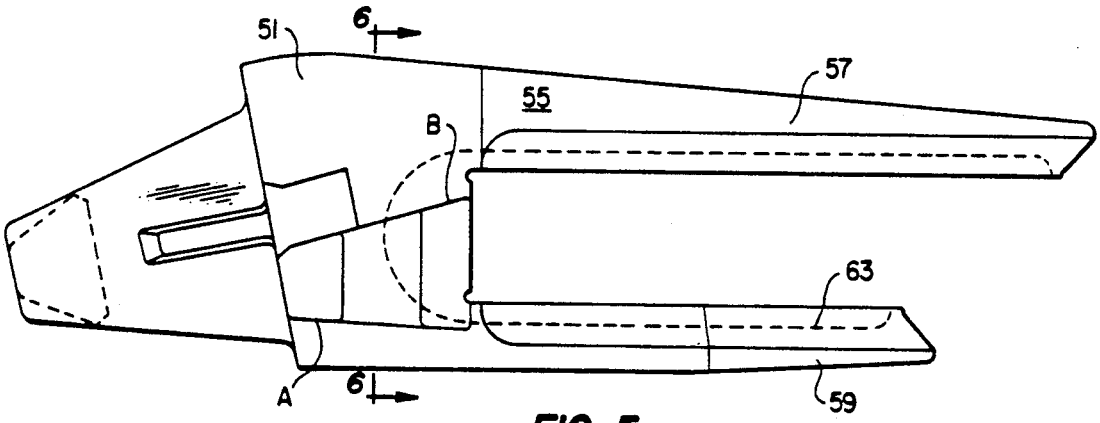
FIG. 5 is a side elevation of the center adapter shown in FIG. 4.
Figure 6:
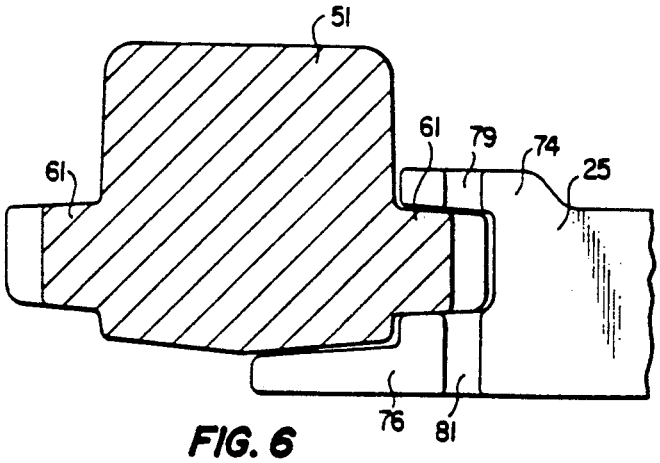
FIG. 6 is a section on the line 6—6 in FIG. 5.
Figure 7:
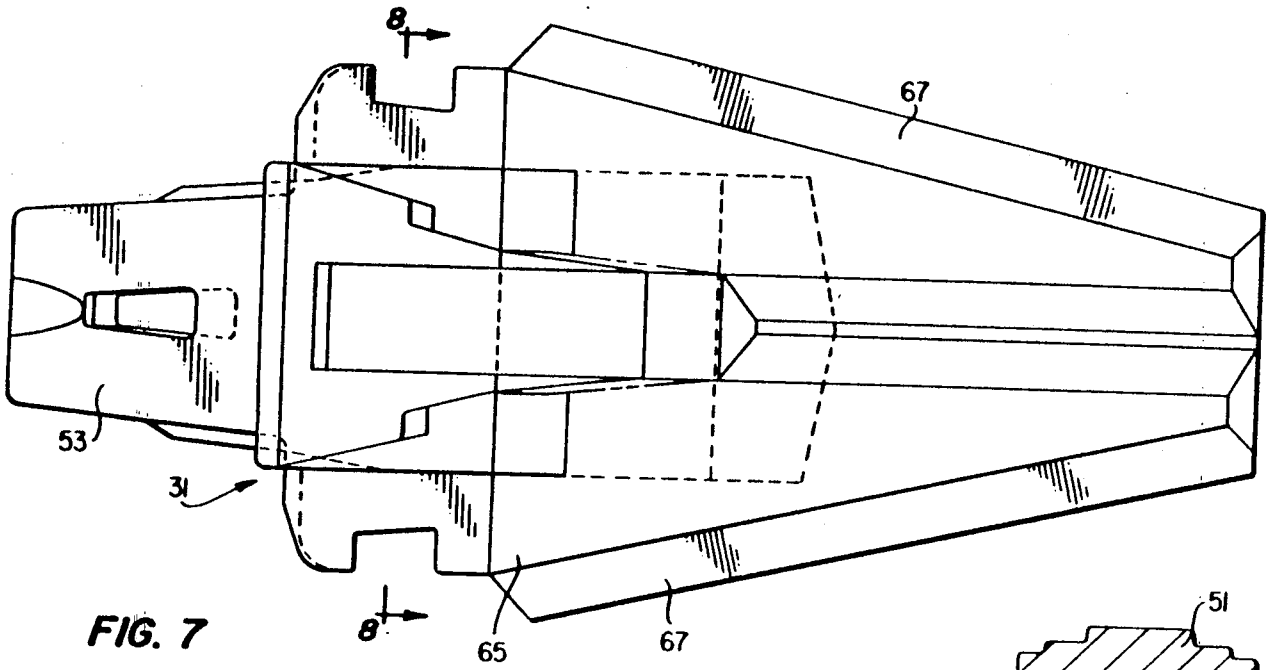
FIG. 7 is a plan view of one of the corner adapters shown in FIG. 1.
Figure 8:
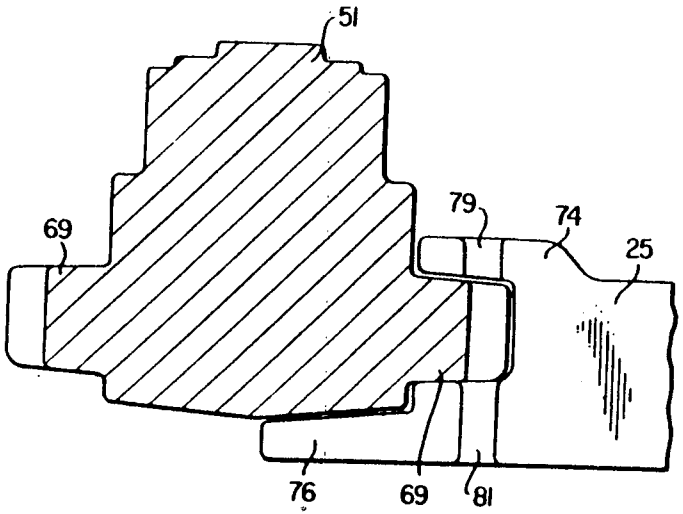
FIG. 8 is a section on the line 8—8 in FIG. 7.

As mentioned above, the wear plate assembly includes six center adapters 29, shown in detail in FIGS. 4, 5 and 6, which are mounted on the adapter-receiving portions 19 and on the center portion 21 of the forward edge 17 of the plate 10, and two corner adapters 31, shown in detail in FIGS. 7 and 8, which are mounted on the outer extremes of the forward edge 17 of the plate 10. Referring firstly to the center adapter 29 shown in FIGS. 4 through 6, each adapter 29 comprises a solid body 51 having a forwardly extending nose 53 on which, in use, a hollow excavating tooth 33 is secured, and a rearwardly extending hollow elongate mounting section 55 which comprises upper and lower, spaced apart, limbs 57 and 59 respectively defining between them a throat 58 which, in use, receives the forward edge 17 of the plate 10. Extending from either side of the adapter body 51 are wedge-shaped lateral flanges 61 which are disposed, as shown in FIG. 5, with their greater dimension towards the edge 17. As shown in FIG. 5, the inwardly facing surface of each of the limbs 57 and 59 is rebated to provide a curved bearing surface 63 on each limb. In use, the flanges 61 are engaged by the adjacent shrouds 25 or 27, in a manner to be described in more detail below and as indicated in FIG. 6.

The corner adapters 31, shown in FIGS. 7 and 8, are substantially similar to the center adapters 29 and each comprises an adapter body 51, a nose 53 on which, in use, an excavating tooth 33 is secured, and a mounting section 65. In the case of the corner adapters 31, however, the mounting section 65 is solid, with longitudinally extending lateral flanges 67 by the inner one of which the corner adapter 31 is secured to the plate lip 10.

The adapter body 51 of each corner adapter 31 has lateral flanges 69 which, in use, are connected to the adjacent angled lip protector shroud 25, as best shown in FIG. 8.

Excavating Teeth

The hollow excavating teeth 33, which generally are of well known construction, are mounted on each respective adapter, using a locking pin described in more detail below. The teeth 33 have on their sides wedge-shaped ribs 70, which when the invention is assembled, project across the front of the lateral ears of the shrouds further securing the shrouds in position on the bucket lip 10.

Lip Protector Shrouds

Figure 9:
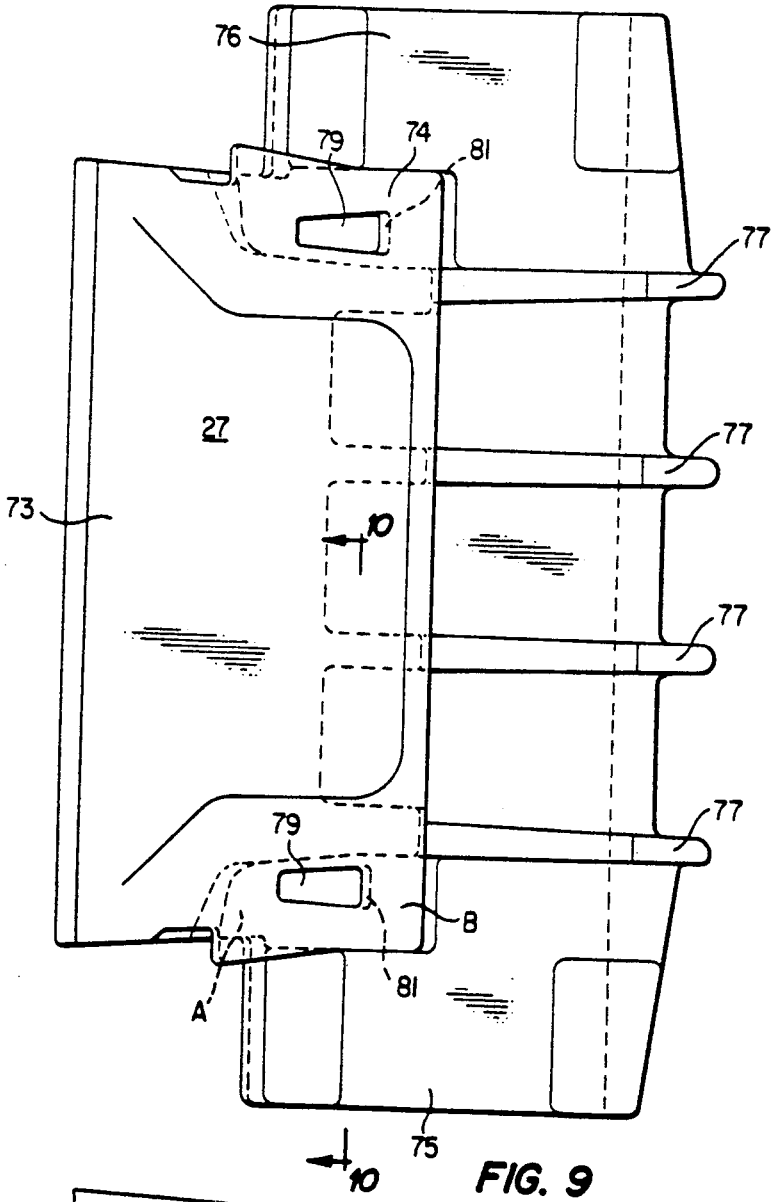
FIG. 9 is a plan of the center lip protector shown in FIG. 1.
Figure 10:
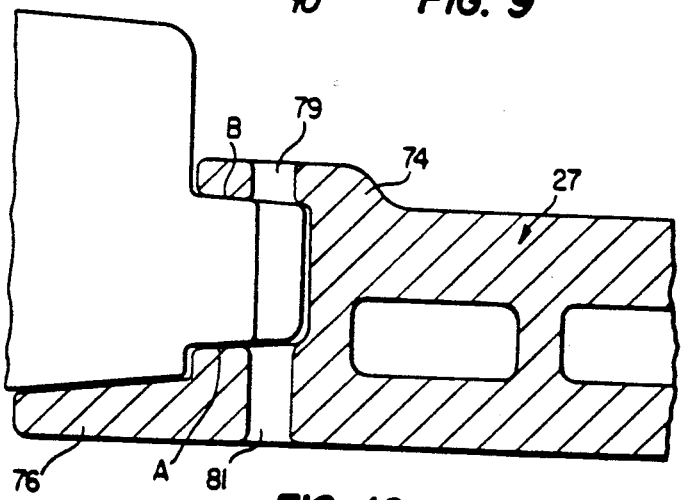
FIG. 10 is a section on the line 10—10 in FIG. 9.
Figure 11:
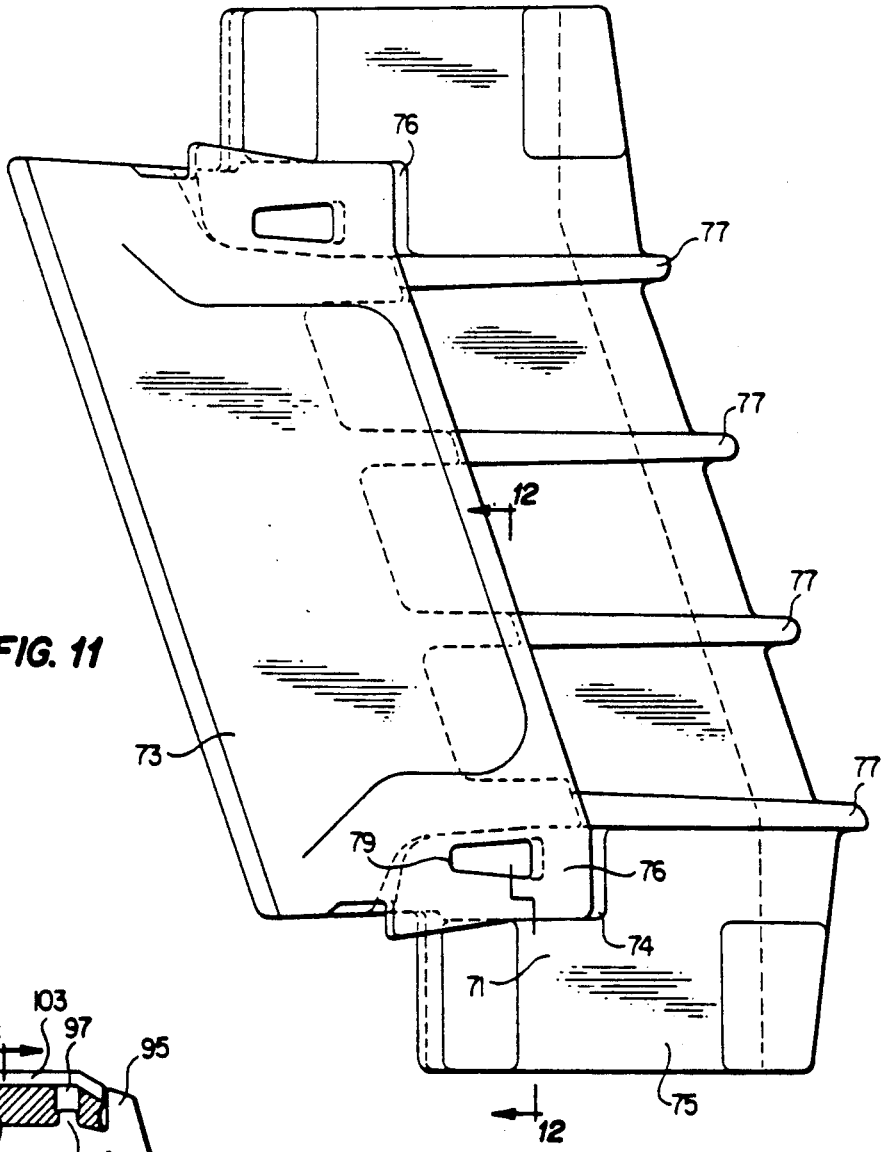
FIG. 11 is a plan of one of the angled shrouds shown in FIG. 1.
Figure 12:
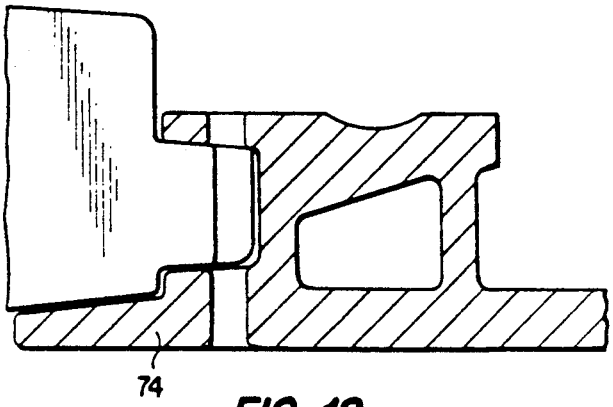
FIG. 12 is a section on the line 12—12 in FIG. 11.

As described above, the wear plate assembly includes six angled lip protector shrouds 25, shown in FIGS. 11 and 12, and a center lip protector shroud 27, shown in FIGS. 9 and 10. Referring first to FIGS. 9 and 10, the center shroud 27 comprises a main body 71 having a forwardly directed wedge-shaped nose 73 and a rearwardly extending base 75 which projects beyond the rear end of the nose 73 and has four upstanding ribs 77.

The nose 73 has, on each side, an upper, laterally extending ear 74 and the base 75 provides corresponding lower, laterally extending ears 76. The upper ears 74 have apertures 79 extending vertically therethrough which register with vertically extending apertures 81 in the lower ears 76, as best seen in FIG. 10.

The angled lip protector shrouds 25 (FIGS. 11 and 12) are essentially similar to the center lip protector shroud 27. Each comprises a main body 71, a wedge-shaped forwardly facing shroud portion 73, a rearwardly extending base 75 with four upstanding ribs 77 and lateral ears 74 and 76. Registering apertures 79 and 81 are provided in the nose 73 and ears 74 and 76, as in the case of the center shroud 27.

The nose 73 and base 75 of each angled shroud 25 are essentially offset from the lateral ears 74 and 76 by the amount necessary to conform to the angle that the angled portion 23 makes with the forward edge 17 of the plate 10. The lateral ears 74 and 76, on the other hand, are directed so as to be parallel to the rear edge 11 of the plate 10 and to mate with the adjacent adapter 29, or 31, on the forward edge 17 of the plate 10, as shown in FIG. 12.

In use, the center lip protector shroud 27 is mounted on the forward edge 17 of the plate 10 between the two inner adjacent center adapters 29. The rear edge of the nose 73 is adjacent the forward edge 17 of the plate 10, and three points of contact, at the zones indicated at A, B, and C in FIG. 4, 5, 9 and 10, are made between the shroud 27 on the one hand and the adapter 29 and wear plate 10 on the other hand: the ribs 77 of the shroud 27 make contact at C with the underside of the plate 10 well to the rear of the forward edge 17 of the plate 10. The underside of the upper ears 74, make contact with a zone B towards the rear of the top surface of the flange 61 of the adapter 58. As seen in FIG. 5, the zone B slope upwardly and rearwardly. The third point of contact A is on the underside of the flange 61, towards its front. As seen in FIG. 5, the zone A slopes downwardly and rearwardly. As will be appreciated, the contact surfaces on the adapter 29 are each angled with respect to the contact surface C. In use, the forces generated during use of the bucket will generate oppositely directed reactor forces in the wear assembly which are directed downwardly at A and upwardly at B to produce a resultant upward force at C, which acts to keep the rear of the lip protector shroud 27 in contact with the underside of the wear plate 10.

As will be appreciated by those skilled in the art, the angled shrouds 27 are mounted between the adjacent adapter with essentially the same contact geometry, so that their rear portions are held securely against the underside of the plate 10 during use by similar reaction forces generated by three points of contact.

Vertical Shroud Assemblies

Figure 3:
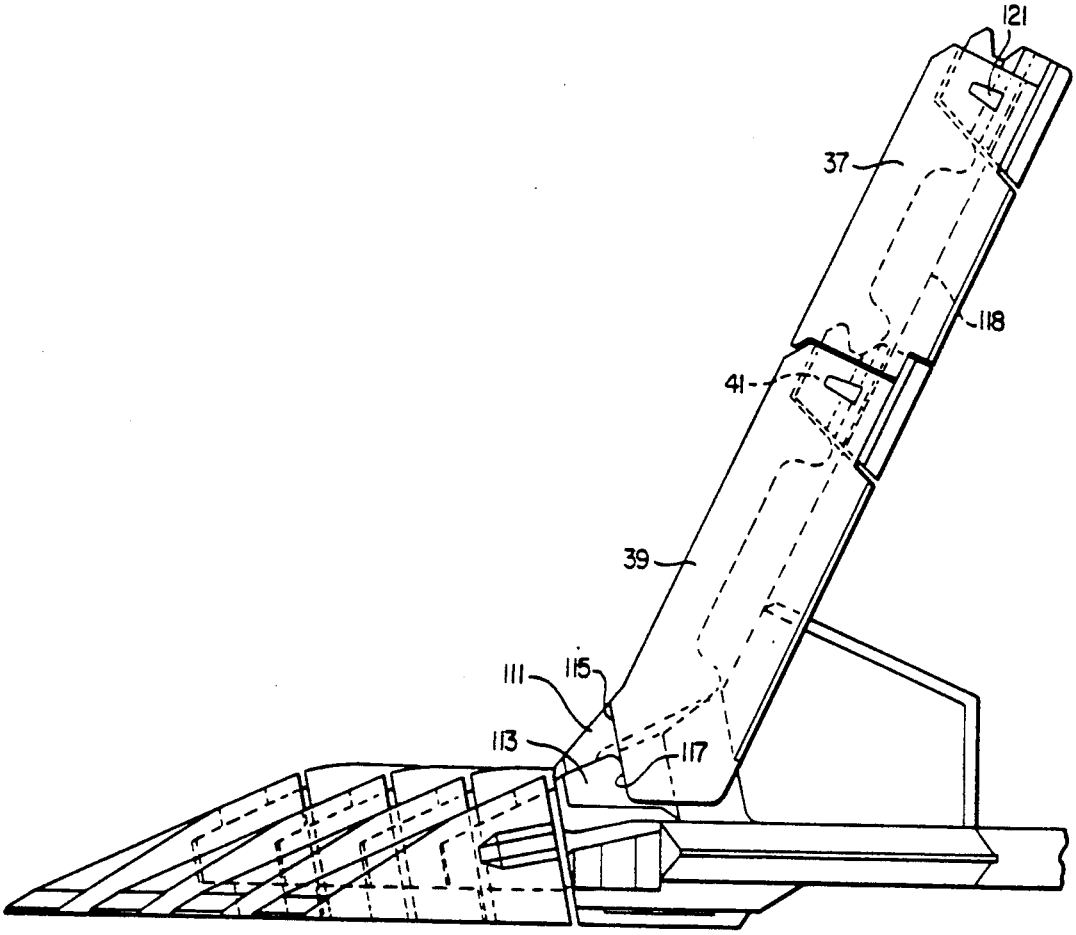
FIG. 3 is a side elevation in the direction 3—3 in FIG. 1.
Figure 2:
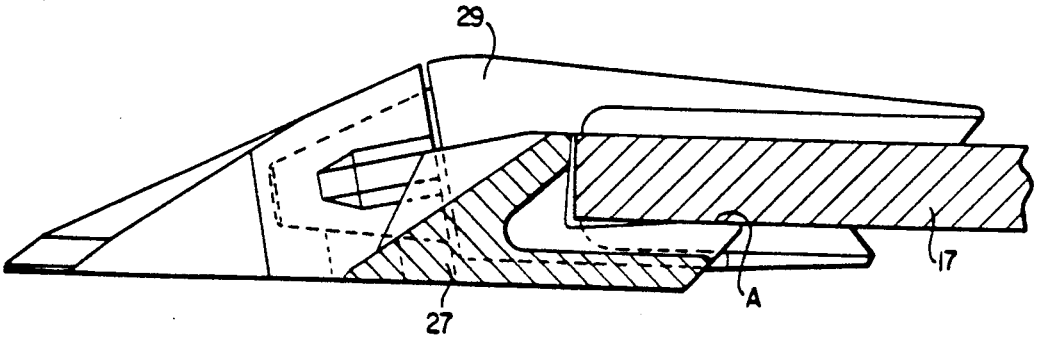
FIG. 2 is a vertical section along the line 2—2 in FIG. 1.

One of the vertical shroud assemblies 35 is shown in FIG. 3 and it will be understood that a similar, mirror image, assembly 35 is provided to protect the other vertical cheek of the bucket.

Figure 15:
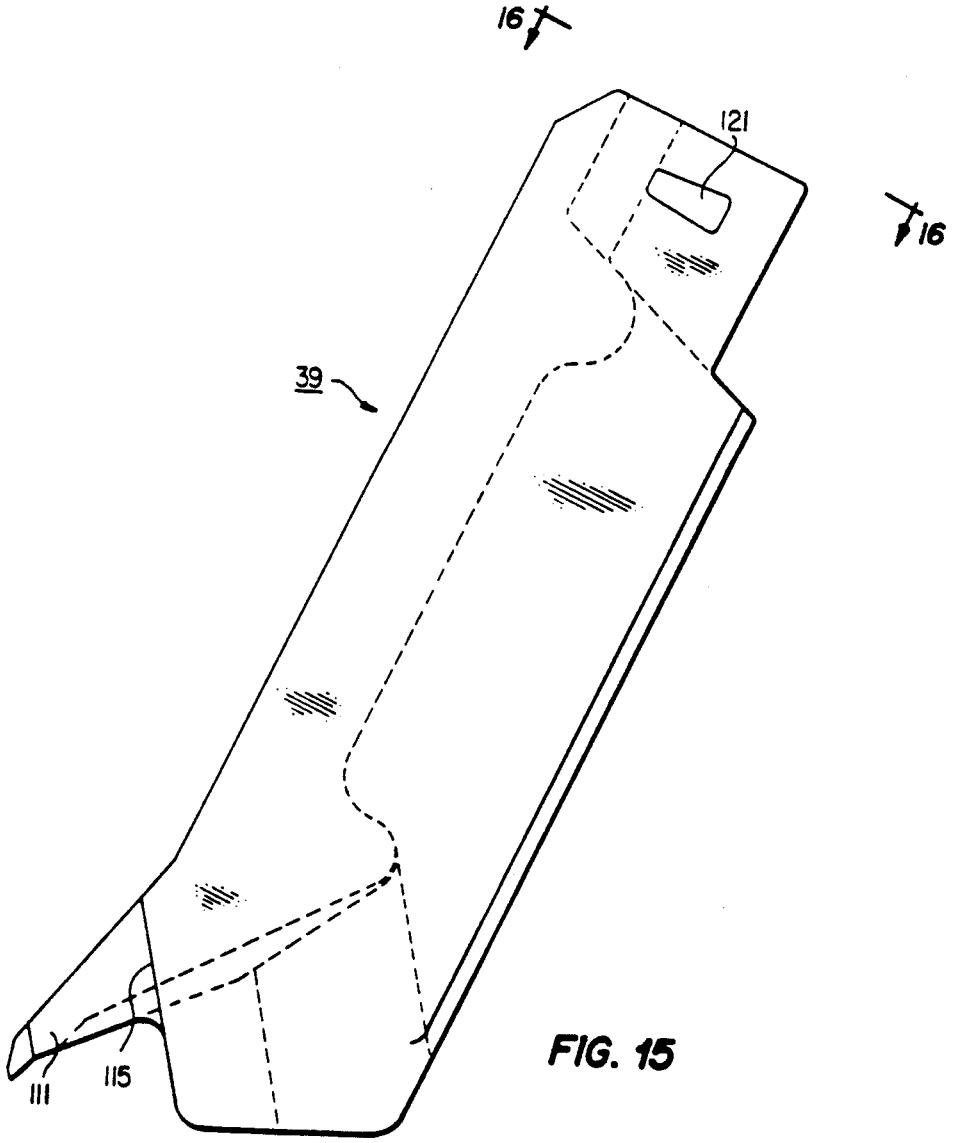
FIG. 15 is a side elevation of one of the lower vertical shrouds shown in FIG. 3.

The lower vertical shroud 39 of the assembly 35 is essentially U-shaped in horizontal section and is mounted on and surrounds the side check of the bucket. As seen in FIGS. 3 and 15, the shroud 39 has at its lower end a forked extremity 111 which engages on either side of a protruberance 113 upstanding from the upper surface of the corner adapter 31. The engagement between the extremity 111 and the protruberance 113 restrains the shroud 39 against forward movement Rearward movement of the shroud 39 is restrained by contact between an inner surface 115 of the shroud and a forward surface 117 of the corner adapter 31. The vertical edge of the bucket is not shown in FIG. 3, but would lie on the dotted line 118.

The vertical shroud assembly is mounted on the bucket by means of the vertical shroud mount 41 which is secured, as by welding, to the bucket. As seen in FIG. 3, the mount 41 fits inside the upper end of the lower shroud 39 and rests with its lower surface on an angled inner surface 119 of the shroud 39. The shroud 39 and mount 41 have aligned apertures 121 and are secured together by means of a flexible pin 91, described in more detail below.

The remainder of the vertical edge of the bucket may be protected by one or more upper vertical shrouds 37, which are mounted on the upper end of the mount 41 and the upper end of the vertical shroud below it, which may be a lower vertical shroud 39, or an upper vertical shroud 37. At its upper end, each upper vertical shroud 37 has a shape complementary to its lower end and has an aperture 113 that registers with the aperture 121 in a second mount 41 which is welded to the bucket edge.

Figure 16:
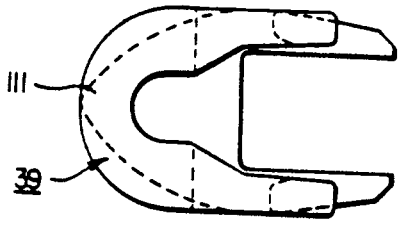
FIG. 16 is a top plan on the line 16—16 in FIG. 15.

As will be appreciated by these skilled in the art, and as illustrated with respect to the lower vertical shroud 39 in FIG. 16, the mounts 41 and upper vertical shrouds 37 are also essentially U-shaped in cross-section to wrap around the bucket edge and protect it from wear. Because the upper and lower ends of the upper shrouds 37 are complementary in shape as many of them as may be needed are juxtaposed to protect the vertical edge of the bucket and are secured thereon by mounts 41.

Pins

Figure 13:
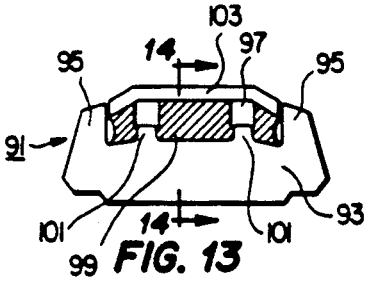
FIG. 13 is a side elevational view of a flexible pin.
Figure 14:
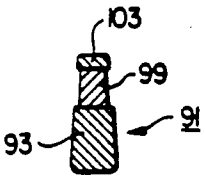
FIG. 14 is a section on the line 14—14 in FIG. 13.

The lip protector shrouds 25, 27 are secured to the adjacent adapters and the excavating teeth 33 to the adapters 29, 31 by flexible pins 91, best seen in FIGS. 13 and 14 and described in detail in U.S. Pat. No. 4,823,487 (Robison). Each flexible pin 91 comprises a body 93 having raised ends 95 defining between them a housing 97 for a rubber insert 99 for example of durometer 80 neoprene located in place by upstanding ribs 101 in the interior of the body 93 extending into the interior housing 97. The flexible pin 91 is completed by a retaining member 103 which is adapted to fit between the ends 95 of the body 93 and to cover the outer edge of the rubber insert 99. The retaining member 103 can be forced towards the body 93 compressing the rubber insert 99 and allowing the flexible pin 91 to be inserted into the apertures in the tooth and adapter, or the adapter and wear shroud. Once inserted, the resilience of the rubber insert 99 forces the retaining member 103 away from the body 93 securing the pin 91 in place and holding the parts of the wear plate assembly together. As will be appreciated, the expansion of the pin 91 acts to force each wear shroud 25, 27, onto its respective adapter 29, 31 further securing the shrouds.

I claim;

1. A wear assembly for a bucket of an excavation apparatus comprising:

a wear plate which, in use, provides a forward lower lip of the bottom wall of the bucket;

a plurality of adapters mounted at spaced apart locations on the forward edge of the wear plate;

a plurality of hollow, replaceable excavating teeth mounted on the adapters;

a plurality of wear shroud means each mounted on the forward edge of the wear plate, said wear shroud means each occupying the space between adjacent adapters being secured to the adjacent adapters by locking pins engaged in registering apertures in the shroud means and adapters, and covering the bottom of the adjacent adapters to provide a wear bearing lower surface of the bucket;

said shroud means being further secured on the wear plate by laterally extending locking portions of the excavating teeth which prevent motion of the shroud means away from the wear plate.

2. A wear assembly according to claim 1 wherein each wear shroud means comprises on main body portion, the bottom of which constitutes the said lower, wear bearing surface, laterally extending upper and lower ears on each side thereof; a rearwardly extending support portion and an inclined, forward nose, which covers the front edge of the wear plate, the bottom of said lower ears being disposed in the plane of the lower surface of the excavating teeth.

3. A wear assembly according to claim 2 wherein each adapter comprises a main body and left and right laterally wedge-shaped flanges which widen towards the rear of the adapter and provide surfaces on which the said shrouds mounted.

4. A wear assembly according to claim 3 wherein the said upper and lower ears having vertical passages extending there through in register with each other and with a vertical passage extending through a laterally-extending flange of the adjacent adapters and including fastening pins extending through said vertical passages in the shroud and adapted to secure the shroud in position.

5. A wear assembly according to claim 1 wherein each wear shroud means has a lower surface disposed in the same plane as the lower surfaces of the excavating teeth.

6. A wear assembly according to claim 1 wherein the wear plate is separate from, but secured to, the bottom wall of the bucket.

7. A wear part assembly for protecting a working edge of a bucket of ground engaging apparatus comprising:

a plurality of adapters, each having a forwardly extending nose, two laterally-extending wedge-shaped flanges and a rearwardly extending mounting portion;

a plurality of hollow, excavating teeth, each removably mounted on the forwardly extending nose of a respective adapter;

a plurality of wear protecting shrouds, each including upper and lower spaced-apart, lateral ears defining between them a wedge-shaped channel adapted to engage the upper and lower surface of the wedge-shaped flanges;

first pin means detachably securing the shrouds between the flanges of adjacent adapters; and second pin means securing each tooth on its respective adapter; and laterally extending locking portions on the excavating teeth extending partially across the front of the wear protecting shrouds and restraining them from movement away from the working edge of the bucket.

8. A wear assembly for protecting the vertical edge of a bucket of a ground engaging tool comprising:

a lower vertical shroud detachably mounted on and surrounding the vertical edge of the bucket and restrained at its lower end against movement away from the vertical bucket edge by engagement between a lower extremity of the lower vertical shroud and an adapter for an excavating tooth;

a generally horizontal aperture in the upper end of the vertical shroud;

a mounting plate secured to the vertical edge of the bucket and engaging at its lower end an upper end of the lower vertical shroud and having an aperture which, in use, is in register with the aperture in the lower vertical shroud;

flexible pin means in the registering apertures in the lower vertical shroud and the mounting plate;

at least one upper vertical shroud, detachably secured to and surrounding the vertical edge of the bucket having a lower extremity, which is complementary, in shape, to the shape of the upper extremity, of the lower vertical shroud, and an upper extremity which is the same shape as the upper extremity of the lower vertical shroud;

a generally horizontal aperture in the upper end of each upper vertical shroud whereby the upper vertical shroud is detachably secured to the bucket edge by means of a second mounting plate secured to the bucket edge and having a registering generally vertical aperture in which is received a flexible pin means.

* * * * *